US007921491B2

(12) United States Patent
Hsu

(10) Patent No.: US 7,921,491 B2
(45) **Date of Patent: *Apr. 12, 2011**

(54) HEALTHY BED FOR ACTIVELY SUPPORTING A HUMAN SPINE CURVE

(76) Inventor: Han-Chung Hsu, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/493,196

(22) Filed: Jun. 27, 2009

(65) Prior Publication Data

US 2010/0325809 A1 Dec. 30, 2010

(51) Int. Cl.
*A47C 27/10* (2006.01)
*A47C 27/08* (2006.01)
*A47C 17/00* (2006.01)

(52) U.S. Cl. ..... 5/710; 5/706; 5/690; 5/728

(58) Field of Classification Search ..... 5/236.1, 5/239, 727, 729, 936, 935, 191, 237, 267, 5/710, 406, 613, 600, 690, 716; 187/267, 187/268

See application file for complete search history.

(56) References Cited

U.S. PATENT DOCUMENTS 4,686,722 A * 8/1987 Swart ..... 5/713
6,487,738 B1 * 12/2002 Graebe ..... 5/719

FOREIGN PATENT DOCUMENTS

WO WO2009026740 3/2009
WO WO2009026743 3/2009
WO WO2009049440 4/2009

* cited by examiner

*Primary Examiner* — Jonathan J Liu
(74) *Attorney, Agent, or Firm* — Ming Chow; Sinorica, LLC

(57) ABSTRACT

A healthy bed for actively supporting a human spine curve mainly comprises a lower base, a plurality of mobilizing devices inside the lower base, a height sensor, a control device, and an inflating device; an upper mattress having an air cushion layer and a plurality of push rods; wherein the control device is used for memorizing the spine curve of a person lying on the upper mattress. When a user lies on the upper mattress, the push rods is are pressed to push the mobilizing devices to move downward, the height sensor detects a moving distance of the mobilizing devices for the control device to determine whether the user is the one whose spine curve is memorized, and if so, then the inflating device is activated to inflate the air cushion layer to let the surface of the upper mattress meet the profile of the spine curve of the user.

6 Claims, 10 Drawing Sheets

HEALTHY BED FOR ACTIVELY SUPPORTING A HUMAN SPINE CURVE

BACKGROUND OF THE INVENTION

1. Field of the Invention

The present invention relates to a healthy bed for actively supporting a human spine curve, which can memorize a spine curve of a user lying on the bed; and when the user lies on the bed again, the healthy bed can actively support the spine curve through air cushions to achieve the best sleep quality.

2. Description of the Prior Art

In modern developed society, workers could suffer from pressures and have insomnia problems, and bad sleep quality could lead to anxiety, depression, headache, muscle soreness, burnout, palpitations and hair loss. Therefore, manufacturers have developed various mattresses such as a healthy mattress, a memory foam mattress, and an energy mattress, which claim to improve sleep qualities. However, because the traditional mattresses use springs to bear the weight of the users, they cannot actively support the users to relieve their stresses, and thus, the insomnia problems still persist.

Therefore, in order to solve the above problems, the applicant of this invention has already filed PCT applications PCT/CN2007/0002585 (citation 1), PCT/CN2007/002602 (citation 2), and PCT/CN2007/002956 (citation 3), which are described below:

Citation 1 discloses a healthy bed which can adjust the human spine curve. The healthy bed comprises a plurality of lifting devices, each lifting device is driven by a motor to lift and lower the independent bed tubes of the mattress so as to let the mattress form a profile corresponding to a human spine curve to actively support the user. However, the motor driven means needs to use a lot of motors, which makes the costs high, thereby making it difficult for massive applications.

Citation 2 discloses another healthy bed which can adjust the human spine curve. The healthy bed comprises a plurality of lifting devices, which uses air bags or water bags to lift and lower the independent tubes of the mattress so as to let the mattress form a profile corresponding to the human spine curve to actively support the user. However, this application needs to use a lot of air bags or water bags, which can be complicated to implement, and which makes the costs high, thereby making it difficult for massive applications.

Citation 3 discloses another healthy bed which can adjust the human spine curve. The healthy bed comprises a plurality of lifting devices, each lifting device comprises a base with a slot being disposed at a front end of the base. Both sides of the slot are fixed with an elastic body. The two elastic bodies support the two ends of the mobilizing rod to let the mobilizing rod move up and down through the elastic forces of the elastic bodies. A height sensor is disposed in the side wall of the slot to detect the moving distance of the mobilizing rod. More than one air cushions is disposed on the base. Each air cushion comprises a sensing bar extending from its top to reach the mobilizing rod. The air cushion is connected with an air pump. The air pump and the height sensor are coupled with a control device. When the air cushion is pressed by a user, the sensing bar is lowered, and the mobilizing rod is pushed downward with a distance, then the height sensor detects the lowest position of the mobilizing rod and transmits the detection result to the control device, then the control device will determine if the person lying down is the user, if so, then the air pump will inflate the air cushion according to the detection result received by the control device to actively support the spine curve of the user to improve sleep quality. Citation 3 has all the components being built in the mattress, however, the bed is too bulky and too heavy to handle.

Therefore, the traditional healthy beds present several shortcomings to be overcome.

In view of the deficiencies of the traditional healthy beds, after years of constant research, the inventor has consequently invented and proposed a healthy bed for actively supporting a human spine curve.

SUMMARY OF THE INVENTION

It is an object of the present invention to provide a healthy bed for actively supporting a human spine curve, which can memorize the spine curve of the user. When the user lies on the mattress, the mattress can actively form a profile corresponding to the spine curve of the user by using the inflation/deflation of the air cushion layer to actively support the spine curve of the user to improve sleep quality.

It is another object of the present invention to provide a healthy bed for actively supporting a human spine curve. The upper mattress is disposed with an air cushion layer therein and the air cushion layer is near the bottom surface. The air cushion layer comprises a plurality of supporting air bags. The healthy bed can actively support the spine curve when the user is lying on the healthy bed with the automatic inflation/deflation of the supporting air bags.

In order to achieve the above objects, the present invention discloses a healthy bed for actively supporting a human spine curve, mainly comprising an upper mattress and a lower base. The upper mattress having a pad, and the pad has an air cushion layer being placed on its top surface. The air cushion layer comprises a plurality of supporting air bags, each supporting air bag connects with an air pipe. A plurality of push rods extend downward from the top surface of the air cushion layer. The air pipes and the push rods protrude out of the bottom of the upper mattress, wherein the lower base is a hollow and has its top surface being disposed with a plurality of slotes. Each slot corresponds to a mobilizing device inside the lower base, and each mobilizing device has a height sensor being disposed under the mobilizing device. The lower base is further disposed with a control device and an inflating device therein. The inflating device and the height sensor are connected with the control device. When the upper mattress is placed on the top surface of the lower base, the push rod enters the slot of the lower base to correspond with the mobilizing device, and the air pipe is connected with the inflating device inside the lower base. The control device is used for memorizing the spine curve of a person lying on the upper mattress. When a user lies on the upper mattress, the push rod is pressed to push the mobilizing device to move downward, and the height sensor detects a moving distance of the mobilizing device and sends the detection results to the control device to determine whether the user is the one whose spine curve is memorized. If so, the control device drives the inflating device to inflate the plurality of supporting air bags to let the surface of the upper mattress meet the profile of the spine curve of the user to achieve the object of actively supporting human spine curve.

These features and advantages of the present invention will be fully understood and appreciated from the following detailed description of the accompanying Drawings.

DETAILED DESCRIPTION OF THE PREFERRED EMBODIMENT

Figure 1:
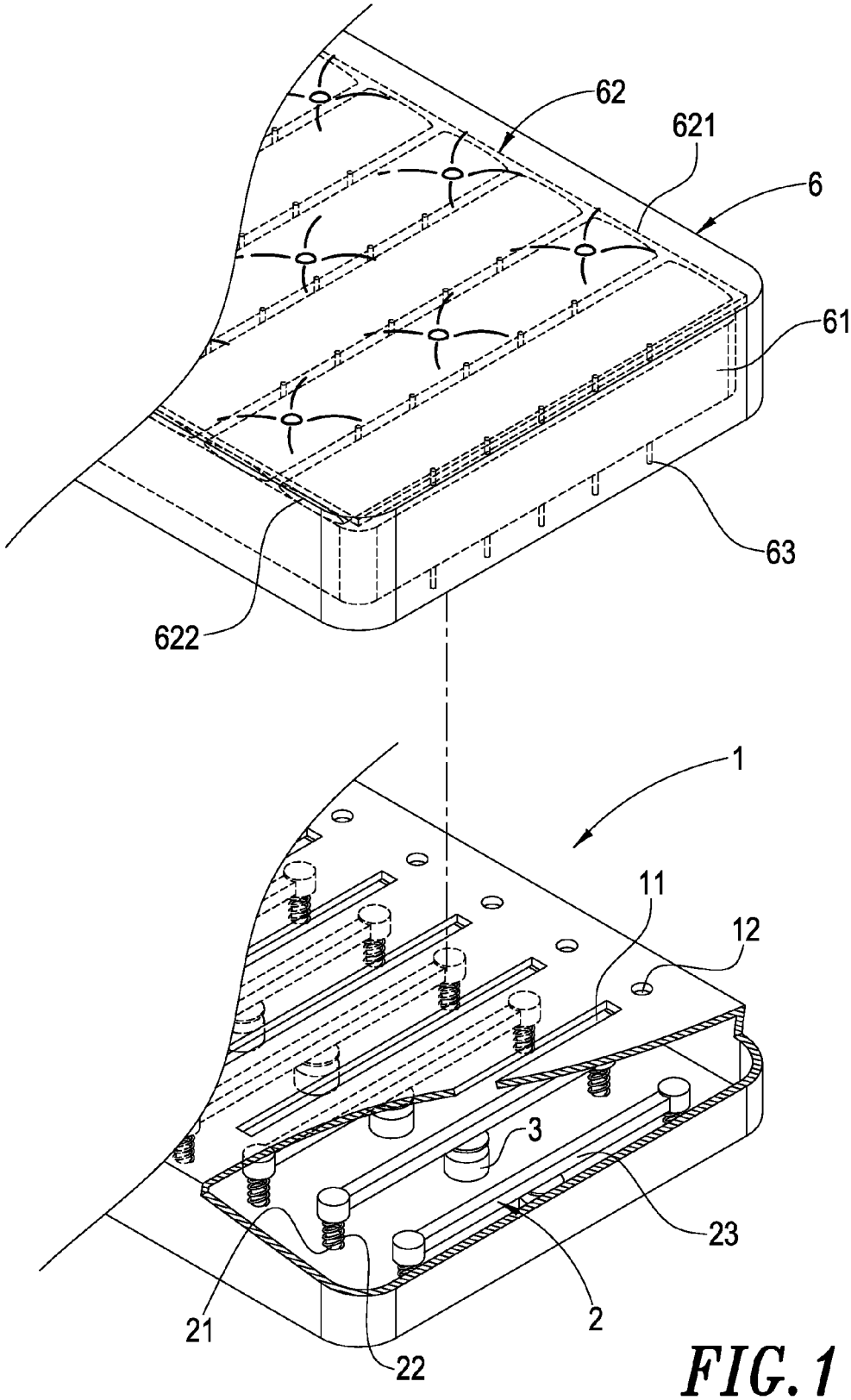
FIG. 1 illustrates a partial perspective view of a healthy bed for actively supporting a human spine curve in the present invention.
Figure 2:
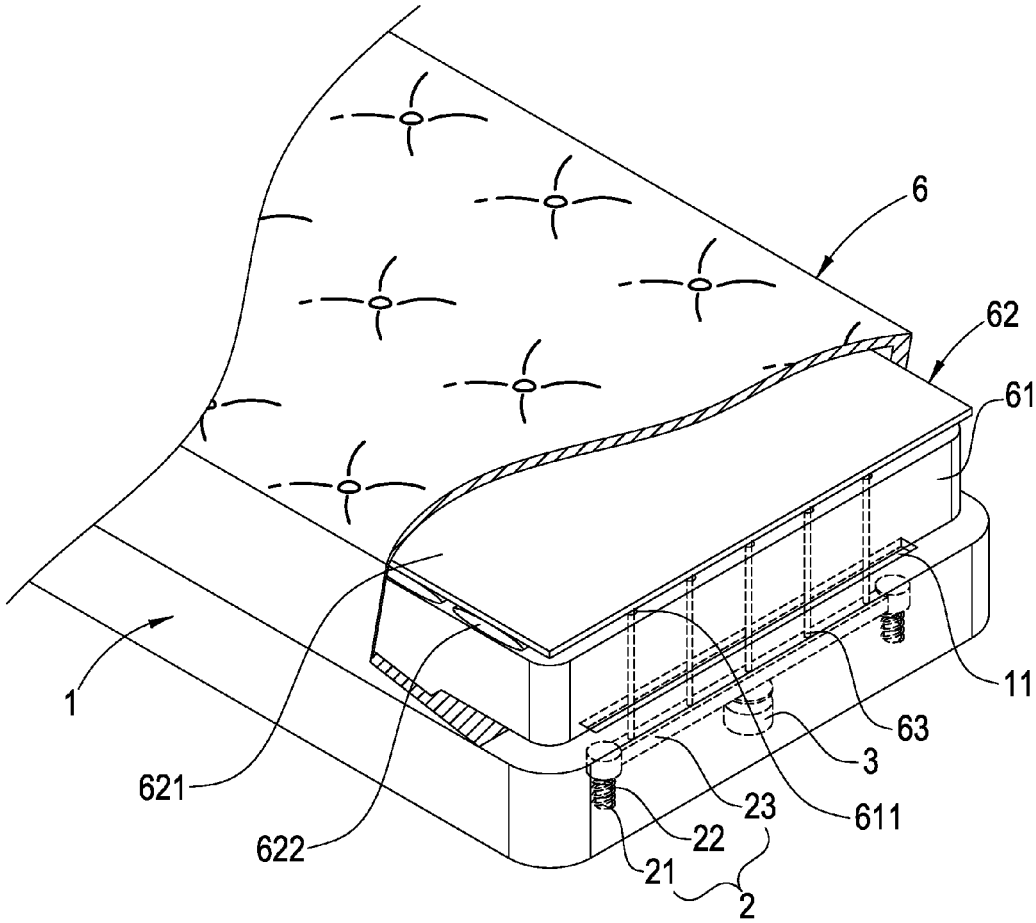
FIG. 2 illustrates another partial perspective view of the healthy bed for actively supporting a human spine curve in the present invention.
Figure 3:
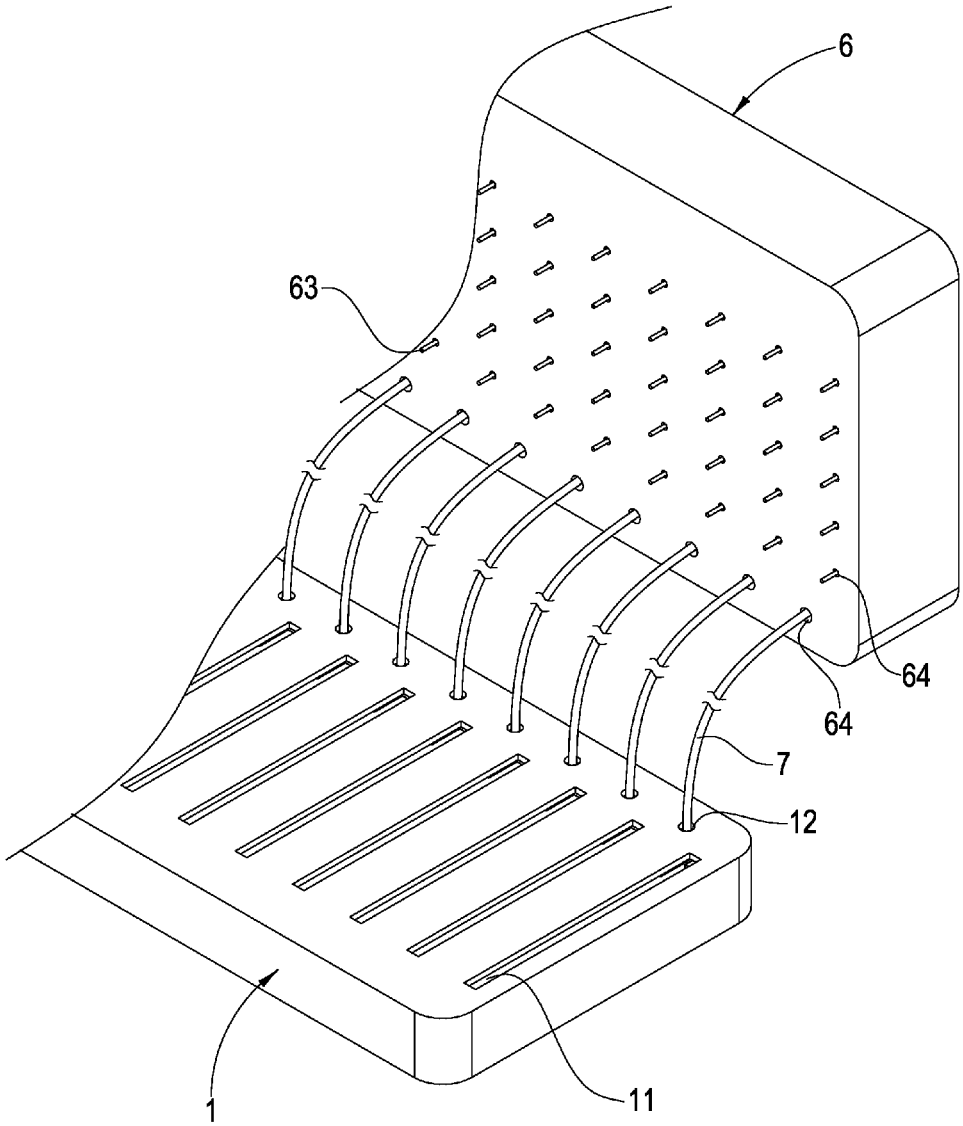
FIG. 3 illustrates another partial perspective view of the healthy bed for actively supporting a human spine curve in the present invention.
Figure 4:
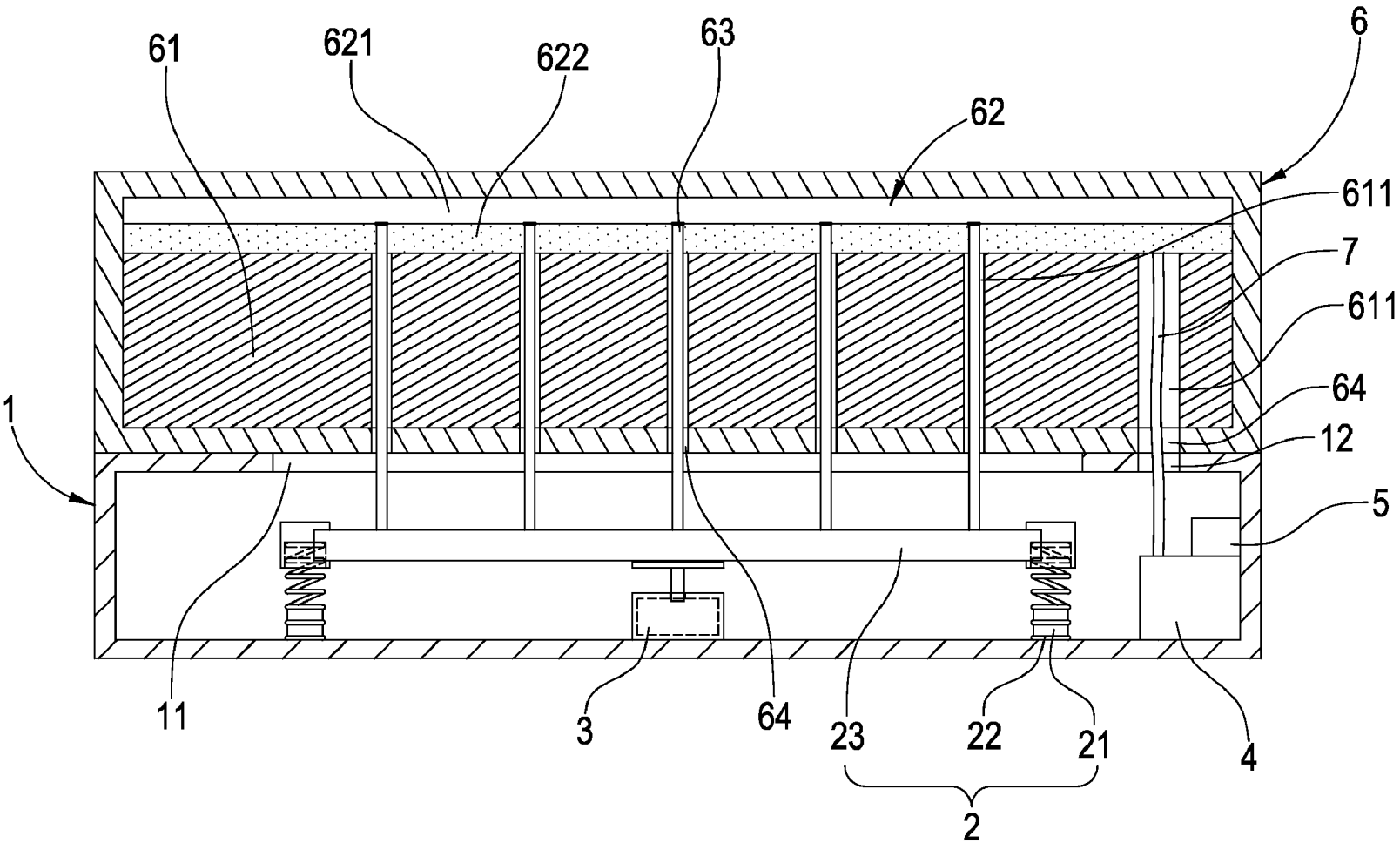
FIG. 4 illustrates a sectional view of the healthy bed for actively supporting a human spine curve in the present invention.
Figure 5:
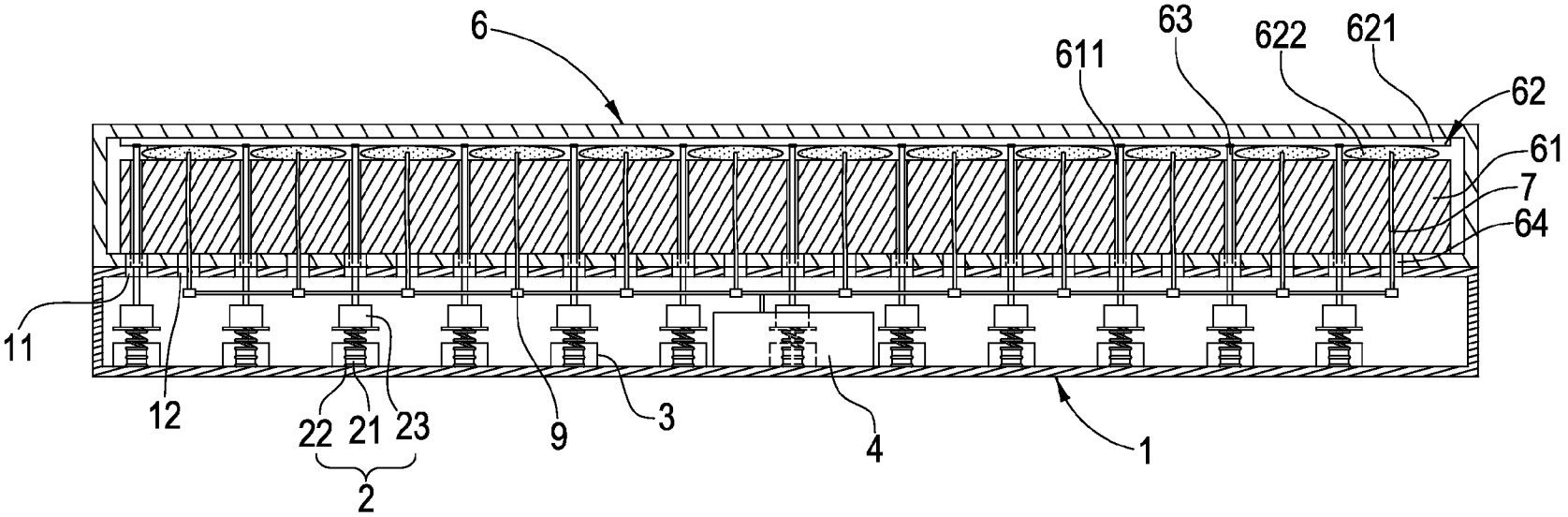
FIG. 5 illustrates another sectional view of the healthy bed for actively supporting a human spine curve in the present invention.

Please refer to FIG. 1 to FIG. 6 for a healthy bed for actively supporting a human spine curve, which mainly comprises: a lower base 1, the lower base 1 is a hollow, and a plurality of slots 11 and pits 12 are disposed on the top surface of the lower base 1. Each slot 11 corresponds to a mobilizing device 2 in the lower base 1. The mobilizing device 2 comprises two corresponding positioning columns 21 with a fixed distance between them. The two positioning columns 21 are fixed on the inner bottom of the lower base 1. Each positioning column 21 is covered with an elastic body 22. Each elastic body 22 supports one end of a mobilizing rod 23 to let the mobilizing rod 23 move up and down through the supports of the elastic bodies 22.

A plurality of height sensors 3, the plurality of height sensors 3 is disposed inside the lower base 1 and placed right under the mobilizing rod 23. When the mobilizing rod 23 is moving downward, it will be in contact with the height sensor 3 to let the height sensor 3 detect a position when the mobilizing rod 23 of the mobilizing device 2 reaches the lowest point.

An upper mattress 6, the upper mattress 6 is disposed with a plurality of hole 64, and a pad 61 placed therein. The pad 61 is disposed with a plurality of through holes 611. Each through hole 611 corresponds to a hole 64 on the bottom of the upper mattress 6. The pad 61 has an air cushion layer 62 being placed on its top surface. The air cushion layer 62 comprises a top layer 621 and a plurality of supporting air bags 622. The plurality of supporting air bags 622 is placed under the top layer 621 equidistantly. Each supporting air bag is implemented with an air hole for inflation/deflation (not shown in figure), and the top layer 621 comprises a plurality of push rods 63 thereon. The push rods 63 go through the through holes 611 of the pad 61 and the holes 64 of the upper mattress 6, and the push rods 63 protrudes out of the holes 64 of the upper mattress 6. The push rods 63 are disposed at both sides of the supporting air bags 622, wherein the upper mattress is disposed on the top surface of the lower base 1 to let the push rod 63 in the upper mattress enter the slot of the lower base and to stick to or to come close to a corresponding mobilizing rod 23 of the mobilizing device 2. The pad 61 can be made of foam materials or cushioning materials.

An inflating device 4, wherein the inflating device 4 is fixed in the lower base 1. The inflating device 4 connects to each supporting air bag 622 through a plurality of pipes 7. The plurality of pipes 7 connect with the supporting air bags 622 and the inflating device 4 through the through holes 611 of the pad 61 of the upper mattress 6 and the pits 12 of the lower base 1.

Figure 6:
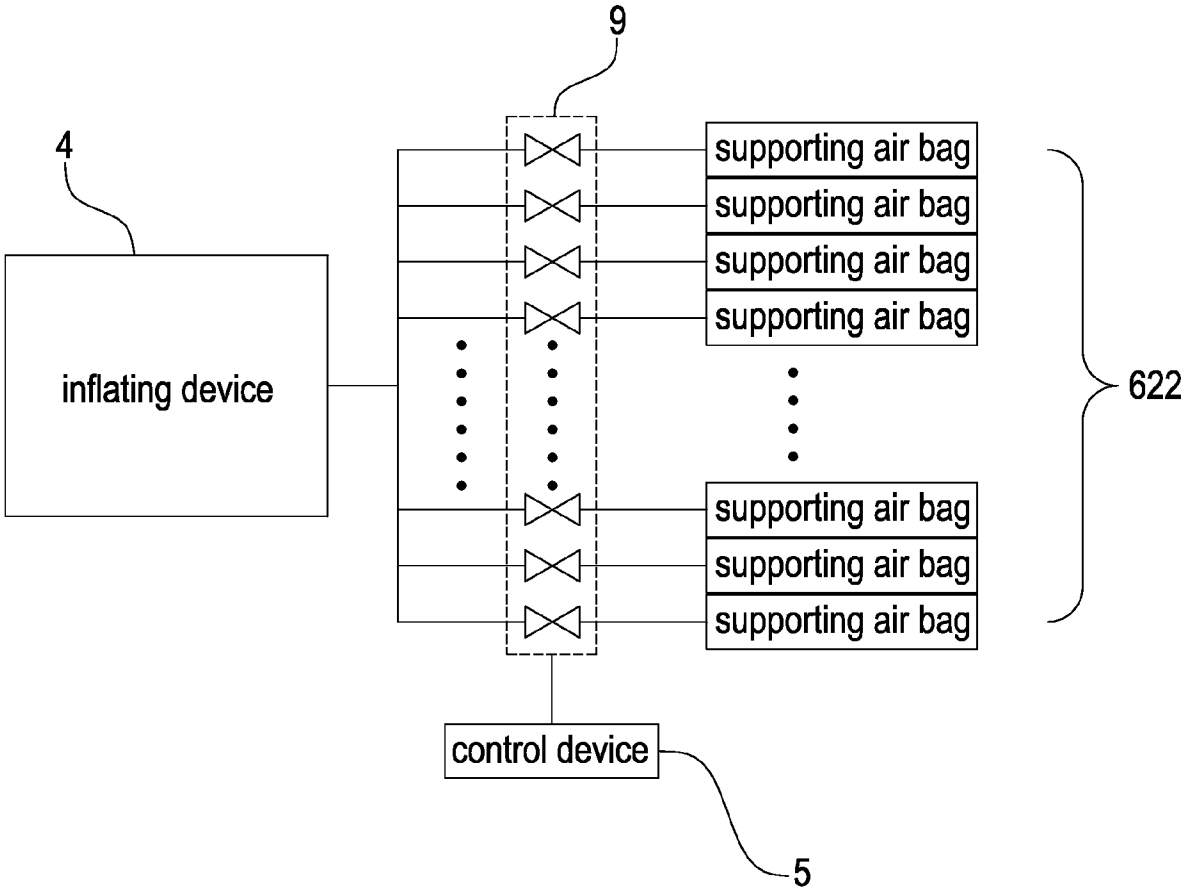
FIG. 6 illustrates a view of the inflating device connecting with the supporting air bag of the healthy bed for actively supporting a human spine curve in the present invention.
Figure 7A:
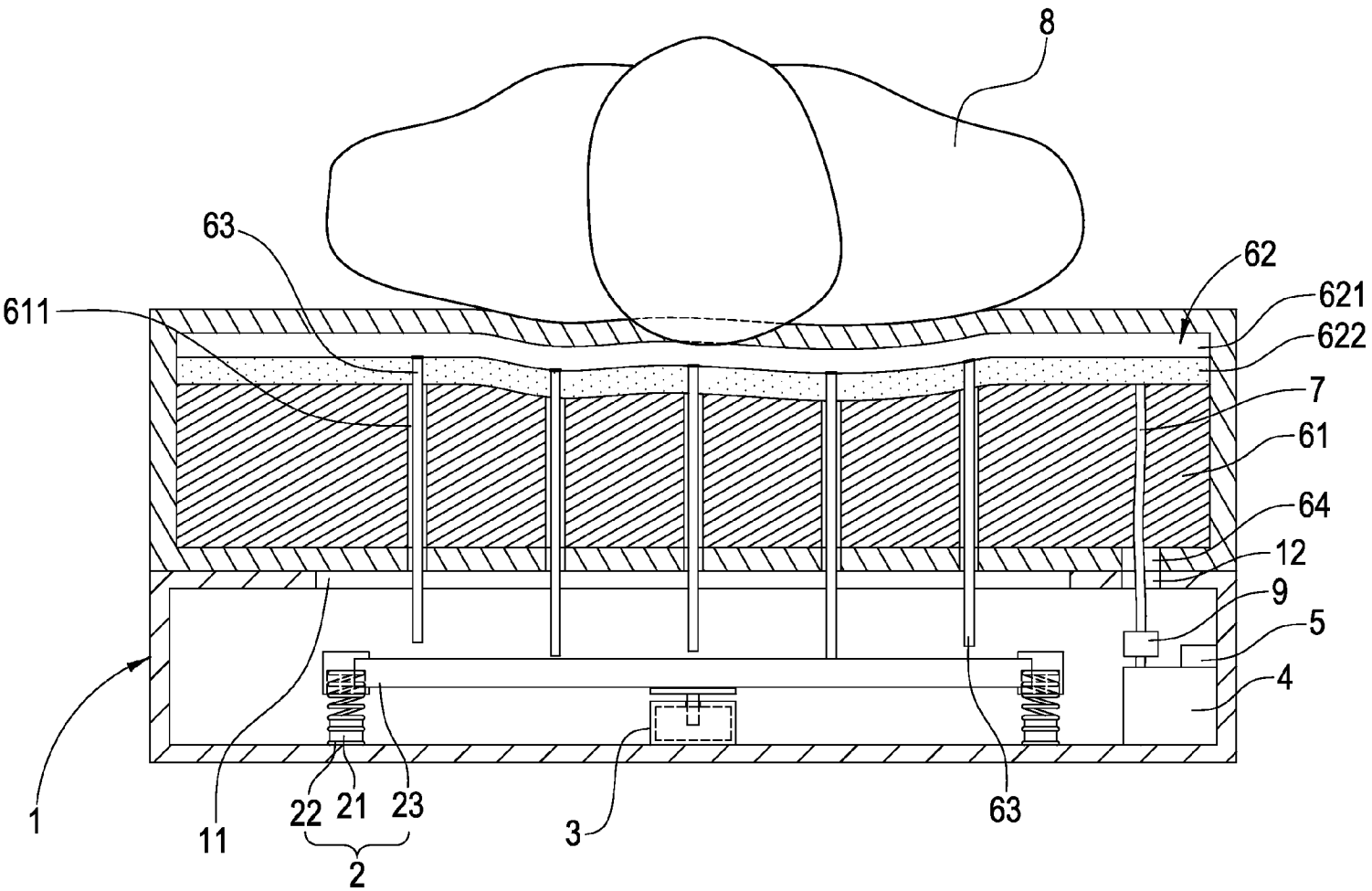
FIGS. 7A and 7B illustrate operational views of the healthy bed for actively supporting a human spine curve in the present invention.
Figure 7B:
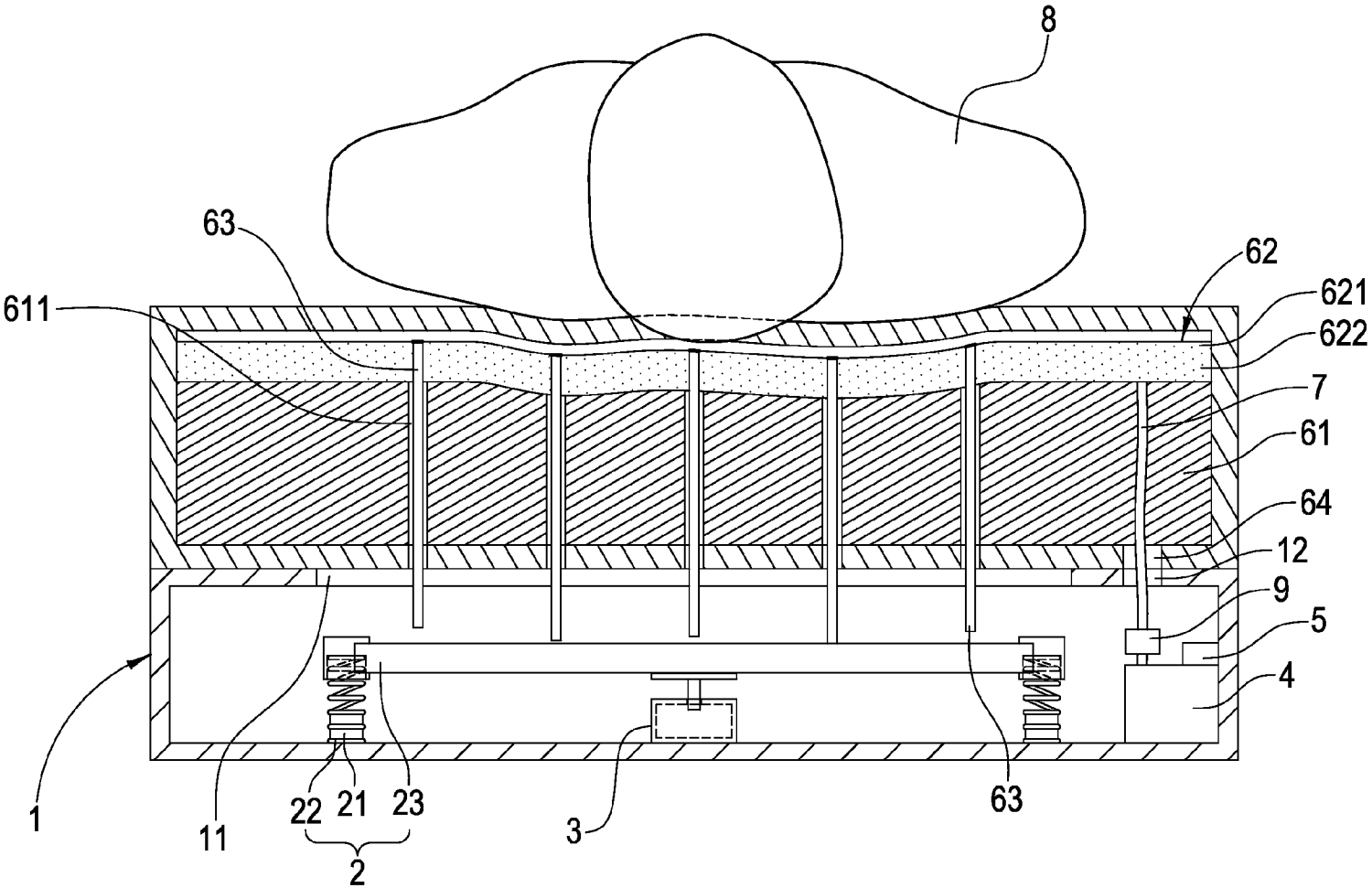
Figure 8A:
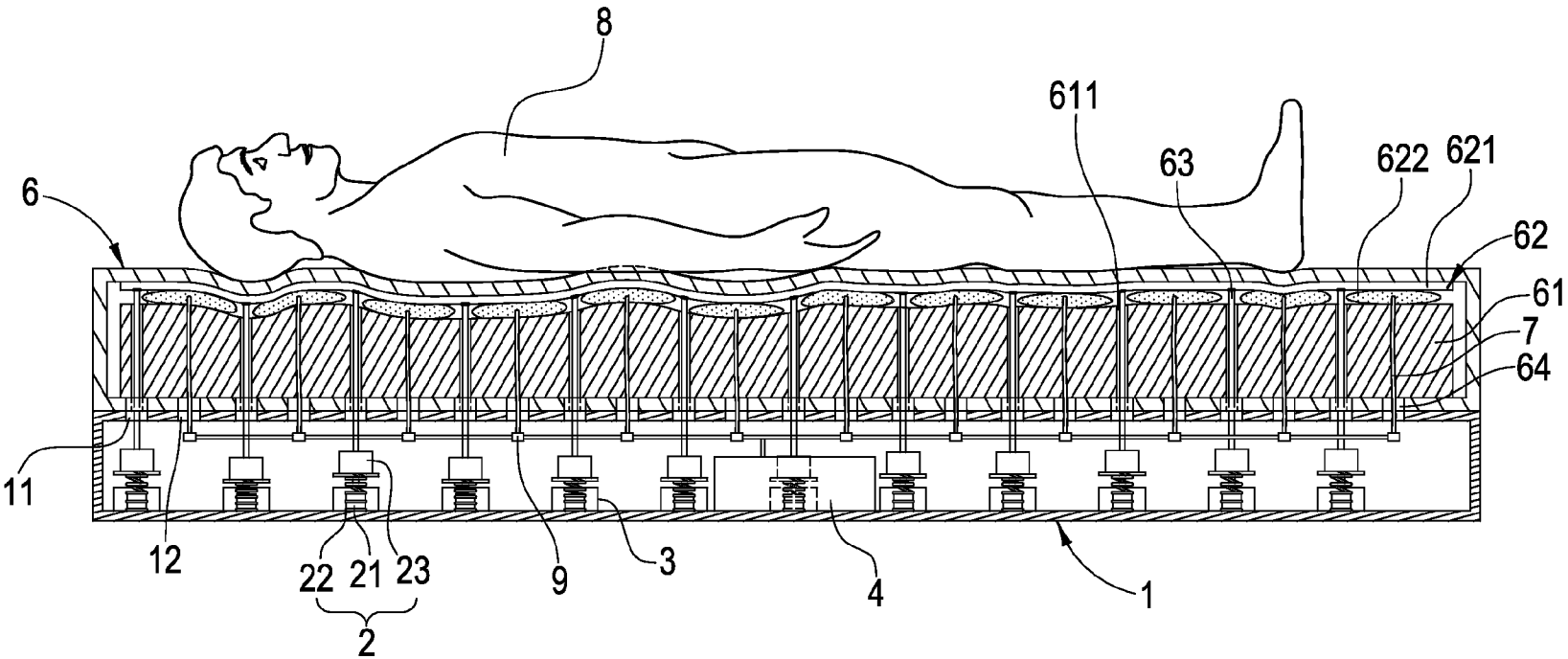
FIGS. 8A and 8B illustrate operational views of the healthy bed for actively supporting a human spine curve in the present invention.
Figure 8B:
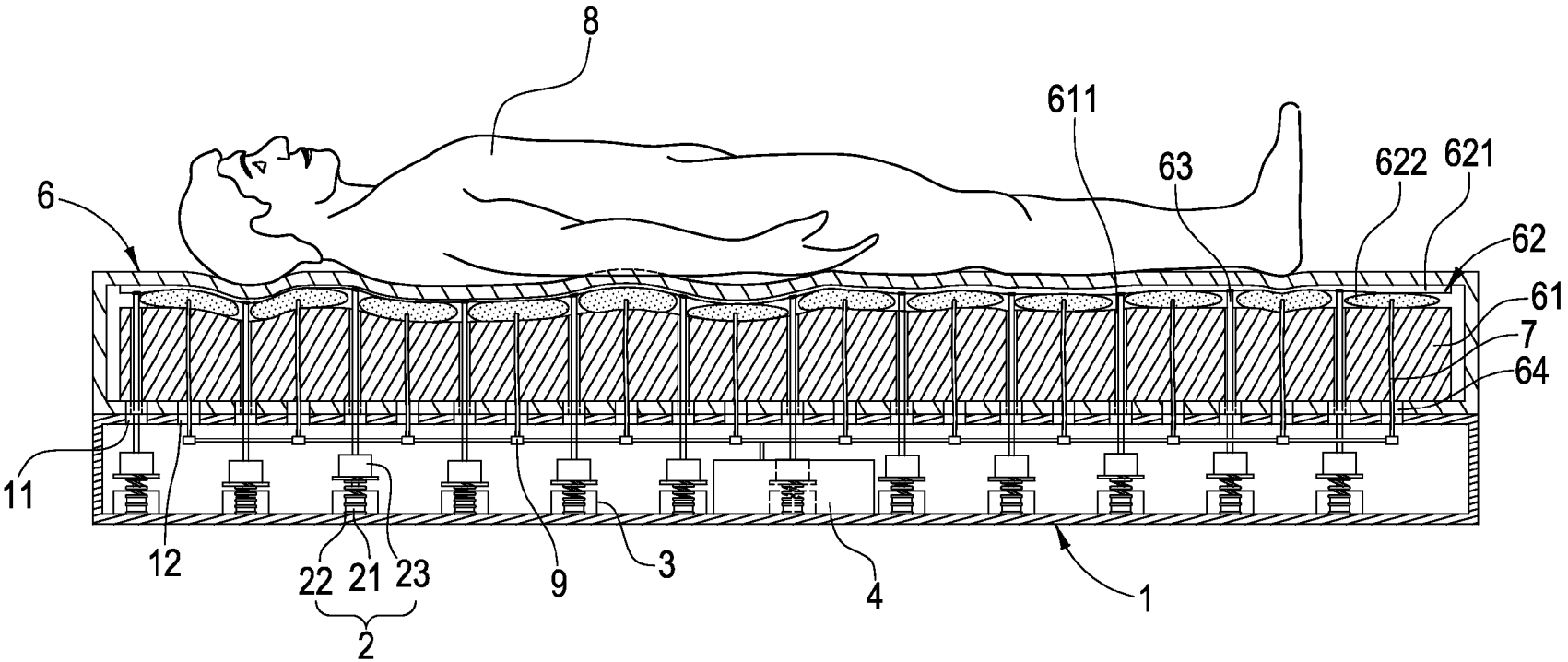

A plurality of control switches 9, as shown in FIG. 6. Each control switch 9 is disposed on each air pipe 7 for controlling the inflation and deflation of each supporting air bag 622.

A control device 5, wherein the control device 5 is fixed in the lower base 1 and connected with the height sensor 3, the plurality of control switches 9 and the inflating device 4, so the control device 7 can receive a detection signal from the height sensor 3 to activate some or all of the control switches according to the detection signal to inflate or deflate each one of the plurality of supporting air bags 622 through the inflating device respectively.

Please refer to FIGS. 7A and 7B, and FIGS. 8A and 8B for operational views of the healthy bed for actively supporting a human spine curve in the present invention. When a user 8 lies on the upper mattress 6 for the first time, the supporting air bags 622 in the upper mattress 6 correspond to the neck vertebrae, thoracic vertebrae, lumbar vertebrae, sacral vertebrae, hip and the legs of the user 8. At this time, the supporting air bags 622 are not bloated, and the push rods 63 of the upper mattress 6 will be pressed by the weight of the user 8. Since each push rod bears different weight, the moving distance of each push rod is different from one another. The push rod 63 bearing the heaviest weight will push the mobilizing rod 23 of the mobilizing device 2 downward, so the mobilizing rod 23 will be in contact with the height sensor 3 to let the height sensor 3 detect a moving distance of each mobilizing rod 23 when it reaches the lowest position. Therefore, the spine curve regards to the neck vertebrae, thoracic vertebrae, lumbar vertebrae, and sacral vertebrae of the user 8 will be determined, and the detection results will be sent to the control device 5 for storage, then the control device 5 will know the air volume of the supporting air bags 622 corresponding to the neck vertebrae, thoracic vertebrae, lumbar vertebrae, and sacral vertebrae of the user 8.

Additionally, the control device 5 memorizes the spine curve of the user 8 for various sleeping postures in advance and supports the spine curves of the user 8 when he/she is changing sleeping postures.

When the user 8 once again lies on the upper mattress 6, which memorizes the spine curve, the control device 5 detects the moving distance of the mobilizing rod 23 to determine if the person is the user 8. If so, then the control device 5 activates the control switches 9 to inflate the supporting air bags 622 respectively through the inflating device 4 if necessary. When a supporting air bag 622 is inflated to a predetermined volume, the control device 5 will deactivate the corresponding control switch 9. Since each control switch 9 has different activating and deactivating times, the upper mattress 6 will form a profile corresponding to the spine curve regarding to the neck vertebrae, thoracic vertebrae, lumbar vertebrae, and sacral vertebrae of the user 8 through the supporting air bags 622, and the supporting air bags 622 will fill the space between the neck vertebrae, thoracic vertebrae, lumbar vertebrae, and sacral vertebrae of the user 8, and the bed will actively support the human spine curve. So when the user 8 is lying on the healthy bed, he/she can get the best support and the best sleep quality.

When the user 8 leaves the upper mattress 6, the push rod 63 moves upward, the mobilizing rod 23 returns to its original position due to the elastic force of the elastic body 22, then the height sensor 3 detects the returning movement of the mobilizing rod 23 and sends the detection signal to the control device 5, the control device 5 drives the inflating device 4 to deflate the bloated supporting air bag 622 to let the top surface of the upper mattress 6 become flat again.

The present invention discloses a healthy bed for actively supporting a human spine curve, while compared with other prior art techniques, is advantageous in:

1. The present invention provides a healthy bed for actively supporting a human spine curve, which can memorize the spine curve of the user, when the user lies on the mattress, the mattress can actively form a profile corresponding to the spine curve of the user by using the inflation/deflation of the air cushion layer to actively support the spine curve of the user to improve sleep quality.

2. The present invention provides a healthy bed for actively supporting a human spine curve, the upper mattress is disposed with an air cushion layer therein and the air cushion layer is near the bottom surface, the air cushion layer comprises a plurality of supporting air bags, the healthy bed can actively support the spine curve when the user is lying on the healthy bed with the automatic inflation/deflation of the supporting air bags.

Many changes and modifications in the above described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A healthy bed for actively supporting a human spine curve comprising:

a lower base, wherein the lower base is a hollow and is disposed with a plurality of mobilizing devices therewithin;

the lower base has a top surface being disposed with a plurality of slots, wherein each of the plurality of slots corresponds to one of said plurality of a mobilizing devices;

a height sensor being disposed under each of the plurality of mobilizing devices;

an upper mattress having a pad therewithin;

the upper mattress having a bottom surface with a plurality of holes which correspond to a plurality of through holes in the pad;

an air cushion layer being placed on a top surface of the pad;

wherein the air cushion layer comprises a top layer and a plurality of supporting air bags under the top layer;

wherein the top layer comprises at least one push rod;

wherein the plurality of holes and through holes allow the at least one push rod to protrudes out of the bottom surface of the upper mattress;

wherein the upper mattress is disposed on a top surface of the lower base to let the at least one push rod in the upper mattress to enter at least one of the plurality of slots of the lower base and to stick to or to come close to a corresponding mobilizing device;

an inflating device fixed in the lower base, wherein the inflating device connects to each supporting air bag of the air cushion layer through a plurality of pipes, so the inflating device can inflate or deflate each of the supporting air bags through the plurality of pipes; wherein other ones of the holes and through holes allow the plurality of air pipes to enter the upper mattress to connect with the plurality of supporting air bags;

a plurality of control switches;

each of the plurality of control switches is disposed on each of the plurality of pipes for controlling the inflation and deflation of each supporting air bag;

a control device;

wherein the control device is fixed in the lower base and connected with the height sensor, the plurality of control switches, and the inflating device, so that the control device is configured to receives a detection signal from the height sensor to activate the plurality of control switches according to the detection signal to inflate or deflate each one of the plurality of supporting air bags through the inflating device respectively, and wherein the top surface of the upper mattress can form a profile corresponding to the spine curve of a user to actively support the user's spine.

2. The healthy bed for actively supporting a human spine curve as claimed in claim 1, wherein pits are disposed on the top surface of the lower base for allowing the plurality of air pipes to enter the lower base and to connect with the inflating device.

3. The healthy bed for actively supporting a human spine curve as claimed in claim 1, wherein each of the plurality of mobilizing devices comprises two corresponding positioning columns with a fixed distance between them, the two positioning columns are fixed on the inner bottom of the lower base, each positioning column is covered with an elastic body, and each elastic body supports one end of a mobilizing rod to let the mobilizing rod move up and down.

4. The healthy bed for actively supporting a human spine curve as claimed in claim 1, wherein the pad in the upper mattress is made of a foam material.

5. The healthy bed for actively supporting a human spine curve as claimed in claim 1, wherein the pad in the upper mattress is made of a cushioning material.

6. The healthy bed for actively supporting a human spine curve as claimed in claim 1, wherein the control device is configured to memorize the spine curve of the user in advance.

* * * * *